US005435667A

United States Patent [19]

Strange

[11] Patent Number: 5,435,667

[45] Date of Patent: Jul. 25, 1995

[54] PROTECTION OF PILES

[75] Inventor: Anthony E. J. Strange, Fairford, United Kingdom

[73] Assignee: Slickbar Products Corp., Seymour, Conn.

[21] Appl. No.: 327,106

[22] Filed: Oct. 21, 1994

Related U.S. Application Data

[63] Continuation of Ser. No. 989,530, Dec. 11, 1992, abandoned, which is a continuation of Ser. No. 263,779, Oct. 20, 1988, abandoned.

[30] Foreign Application Priority Data

Feb. 20, 1986 [GB] United Kingdom ..... 8804285

[51] Int. Cl.[6] ..... E02D 5/60; E02D 31/06

[52] U.S. Cl. ..... 405/216; 405/211; 52/515; 428/57; 428/192; 428/230

[58] Field of Search ..... 405/211, 216; 52/170, 52/515, 516, 727, 728; 138/110, 156, 157, 158, 159; 204/197; 285/39; 428/57, 58, 192, 230, 231

[56] References Cited

U.S. PATENT DOCUMENTS

| | | | |
|---|---|---|---|
| 934,176 | 9/1909 | Hubbard . | |
| 2,522,277 | 9/1950 | Knowland . | |
| 2,928,411 | 3/1960 | Johnson | 405/216 X |
| 3,025,689 | 3/1962 | Beghelli . | |
| 3,321,924 | 5/1967 | Liddell . | |
| 3,341,178 | 9/1967 | Cott | 285/39 X |
| 3,736,759 | 6/1973 | Blose . | |
| 3,890,795 | 6/1975 | Maurer . | |
| 3,917,501 | 11/1975 | Ferrucci et al. | 156/279 |
| 3,939,665 | 2/1976 | Gosse et al. . | |
| 3,994,794 | 11/1976 | Bohne | 204/197 |
| 3,996,757 | 12/1976 | Liddell . | |
| 3,999,399 | 12/1976 | Maurer . | |
| 4,023,374 | 5/1977 | Colbert et al. . | |
| 4,068,483 | 1/1978 | Papworth . | |
| 4,081,941 | 4/1978 | Van Ausdall | 52/726 |
| 4,202,850 | 5/1980 | Yamamoto et al. | 254/128 |
| 4,297,408 | 10/1981 | Stead et al. . | |
| 4,306,821 | 12/1981 | Moore | 405/216 |
| 4,371,578 | 2/1983 | Thompson | 428/192 |
| 4,408,931 | 10/1983 | LeBlanc et al. | 405/213 |

(List continued on next page.)

FOREIGN PATENT DOCUMENTS

| | | | |
|---|---|---|---|
| 411382 | 10/1935 | Belgium . | |
| 188358 | 7/1986 | European Pat. Off. | 405/216 |
| 2337792 | 8/1977 | France . | |
| 2449703 | 4/1975 | Germany . | |
| 31943 | 3/1981 | Japan | 405/216 |
| 58-29916 | 2/1983 | Japan | 405/211 |
| 58-123927 | 7/1983 | Japan | 405/216 |
| 59-220533 | 12/1984 | Japan | 405/211 |
| 1439214 | 6/1976 | United Kingdom . | |
| 1503464 | 3/1978 | United Kingdom . | |
| 1546710 | 5/1979 | United Kingdom . | |
| 2159561 | 12/1985 | United Kingdom | 405/211 |

OTHER PUBLICATIONS

"Corrosion Report Cathodic Protection of Offshore Equipment," *OFFSHORE*, vol. 29, No. 4, Apr., 1969, pp. 48, 54, 142.

"Piling Repair," *Civil Engineering*, vol. 49, No. 5, May, 1979, p. 118, item 255.

*Primary Examiner*—Randolph A. Reese
*Assistant Examiner*—John A. Ricci
*Attorney, Agent, or Firm*—Ware, Fressola, Van Der Sluys & Adolphson

[57] ABSTRACT

A pile wrapper is in the form of a flexible sheet (1,2) which, when encircling a pile, has two contiguous edges. These have abutments (8) which are urged together by a power tool (13) and fastened, conveniently by nuts (19) and bolts (18). The hoop tension induced in the wrapper resists wave suction forces. The wrapper can have an inner layer (2) containing a water resistant sealant which is forced into intimate contact with the pile as the tension is applied. The wrapper may also be given anti-fouling and cathodic protection properties.

25 Claims, 2 Drawing Sheets

U.S. PATENT DOCUMENTS

Figure 1:
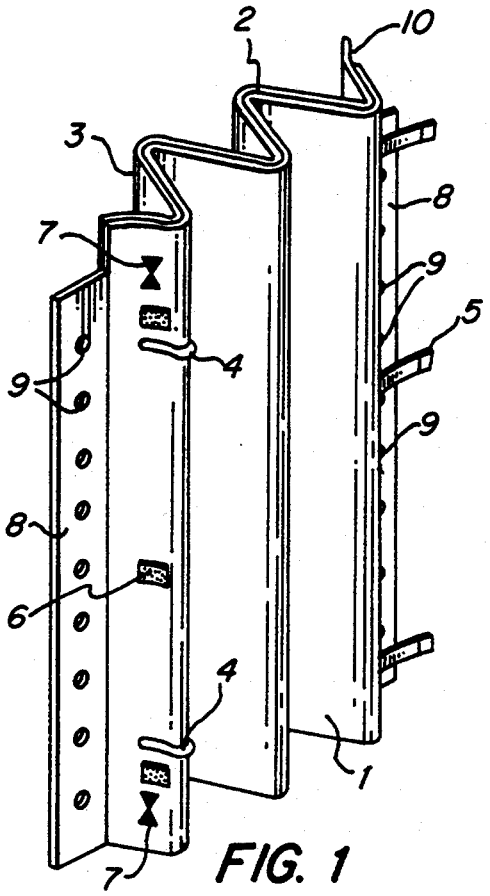

| | | | |
|---|---|---|---|
| 4,411,556 | 10/1983 | LeBlanc et al. | 425/213 |
| 4,415,293 | 11/1983 | Engel et al. | 405/216 |
| 4,445,806 | 5/1984 | Crain | 405/216 |
| 4,448,824 | 5/1984 | Holmes et al. | 428/57 X |
| 4,493,174 | 1/1985 | Arens | 52/727 X |
| 4,506,485 | 3/1985 | Apostolos | 52/515 |
| 4,532,158 | 7/1985 | Steele et al. | 428/192 X |
| 4,532,168 | 7/1985 | Steele et al. | 428/192 X |
| 4,543,764 | 10/1985 | Kozikowski | 52/746 |
| 4,585,681 | 4/1986 | Kidera et al. | |
| 4,593,721 | 6/1986 | Klenk et al. | 428/192 X |
| 4,606,964 | 8/1986 | Wideman | |
| 4,713,129 | 12/1987 | Inhofe et al. | 405/216 X |
| 4,719,049 | 3/1987 | Shaw et al. | 405/216 |
| 4,731,273 | 3/1988 | Bonk et al. | 428/57 |
| 4,764,054 | 8/1988 | Sutton | 405/216 |
| 4,842,022 | 6/1989 | Oxley et al. | 428/57 |
| 4,892,771 | 1/1990 | Rowland | 428/192 X |
| 5,043,388 | 8/1991 | Yamamoto et al. | 525/133 |
| 5,059,648 | 10/1991 | Fukushima et al. | 524/376 |

PROTECTION OF PILES

CROSS-REFERENCE TO RELATED APPLICATION

This is a continuation of U.S. patent application Ser. No. 07/989,530, filed Dec. 11, 1992 now abandoned, which is a continuation of Ser. No. 07/263,779, filed Oct. 20, 1988, now abandoned.

This invention relates to the protection of piles or risers, such as those of oil rigs, piers or jetties. For convenience, the specification will simply refer to piles.

These are usually massive steel tubing, or concrete or wooden members. Although they may initially be painted or otherwise coated, they inevitably become subject to corrosion or bacterial attack in the hostile environment of sea water. This is particularly so over the splash zone, where the pile is alternately wetted and dried.

It is comparatively easy to apply a protective sheathing to such a structural member before it is placed in the sea, for the job can be done in comfortable and dry conditions. However it is not always desirable to put such sheathing on beforehand, as it may easily be damaged in transit to the site. Also, of course, there are thousands of existing piles already in place, corroding away and needing attention.

There have been various proposals for sheathing such piles in situ. The difficulties are formidable, starting with the need in most cases to clean the pile of virtually every trace of marine growth and corrosion. The favoured approach then has been to construct a jacket around the pile leaving an annular space, sealed around the bottom so that it can be emptied of water. Then a filler material is poured in; for example concrete is suggested in British Patent No. 1352226. Other proposals have been for an inert bonding material as in British Patents Nos. 1546710 and 1557071, or Specification No. 2108566A. Such a jacket has to be tailor-made for the particular size of pile, and it also has to be in two parts at least so that it can be assembled around the pile. There also have to be spacers to keep the jacket uniformly distanced around the pile, adding to the complexity and cost.

Another drawback is that once such sheathing has been fitted it is permanent unless completely destroyed. There can be no absolute guarantee that corrosion will be kept at bay by any of these systems, and it is desirable from time to time to make a visual inspection. Existing sheathing systems make this extremely difficult and expensive, and there is the temptation to assume all is well underneath.

Thus, there is a need for a somewhat simpler encasement system, and one that will allow fairly easy replacement, or even re-use after removal for inspection. It would also be advantageous to have a wrapping that could sustain minor damage and keep its sealing properties for a reasonable length of time thereafter, without deterioration. A further need is for a wrapping that is virtually complete in itself-and does not need the prior positioning of an assembly of moulds or formers. Any protective system should also advantageously be resistant to marine growth and, particularly for steel piles protect agains electrolytic action.

According to one aspect of the present invention there is provided a pile wrapping comprising a flexible sheet with means along opposed edges when the wrapping is positioned around a pile for fastening such edges together and affording counter-abutments for the application of a tool by which hoop stresses can be imposed on the wrapping before fastening is complete The sheet will have a certain elasticity, but the hoop stresses applied can be made sufficient to prevent the sheet being sucked clean off the pile by wave action.

The sheet preferably comprises an outer skin of water impermeable flexible material and an inner layer of liquid permeable material bonded to the skin and impregnated with a water resistant sealant.

Preferably, the outer skin will be of reinforced plastics material while the inner layer may be of felted or porous plastics material. The outer skin may have a thickness of the order of 3 mm, and a suitable material is that used for the skirts of hovercraft. The thickness of the inner layer may be of the order of 6 mm, or at least sufficient to accommodate to variations in surface profile of that order of magnitude.

The wrapping is intended to go once around the pile, which is normally cylindrical. To help complete the seal at the contiguous edges the inner layer may have an extension beyond one edge to tuck under the opposite one.

The sealant impregnated in the inner layer may have other properties beyond just being water-tight. It may incorporate corrosion inhibiting and anti-fouling components. Preferably, it will not form a permanent bond to a pile surface, and the fastening means will be releasable, so that the wrapping can be easily removed for inspection, and later re-used.

The inner layer and sealant will generally be covered by a removable backing sheet on manufacture, which will be discarded before positioning around the pile.

The wrapping sheet may also be adapted to form an element of a cathodic protection system, being a carrier for sacrificial anode material, or forming a jacket with a high dielectric constant, for example. It could also carry anti-fouling material externally.

To assist in fitting this wrapping, the sheet may be outwardly provided with handles so that divers can manoeuvre it into position. Also, it will be advantageous to have temporary strap fasteners for holding the wrapping around a pile at least during an initial phase of securing the permanent fastening means. Conveniently, there will also be gauge marks to provide an indication of the hoop stresses imposed.

The fastening means preferably comprises substantially rigid apertured flanges, outwardly projecting from the edges, and bolts for securing through the apertures.

According to another aspect of the present invention there is provided a method of protecting a pile comprising wrapping a sheet as outlined above around the pile and drawing and securing opposite edges together by the fastening means to create hoop tensions that are resistant to wave suction forces.

With the sealant version, this tensioning causes the sealant to exude into any surface irregularities. The pile will normally be cleaned first, but it need not be done so with the meticulousness of some previous systems, Any vestigial marine growths or other imperfections will be firmly encapsulated and rendered impotent due to lack of oxygen and/or reaction to corrosion or anti-fouling inhibitors.

For a fastening operation, with the wrapping having apertured flanges as referred to above, tools may be engaged through some of the apertures to draw the opposite edges together. Bolts are then engaged through others of said apertures in a first securing operation, the tools are removed, and replaced by bolts in a second securing operation.

The wrapping will usually be positioned at least partially under water and during the initial stages it will conveniently be supported by buoyancy bags as it is positioned by divers around the pile.

It is not practical to sheath a complete pile with a single such sheet. Where this is desired, a series of sheets will be wrapped around the pile, butted together and sealing means applied around the butt joints.

Figure 2:
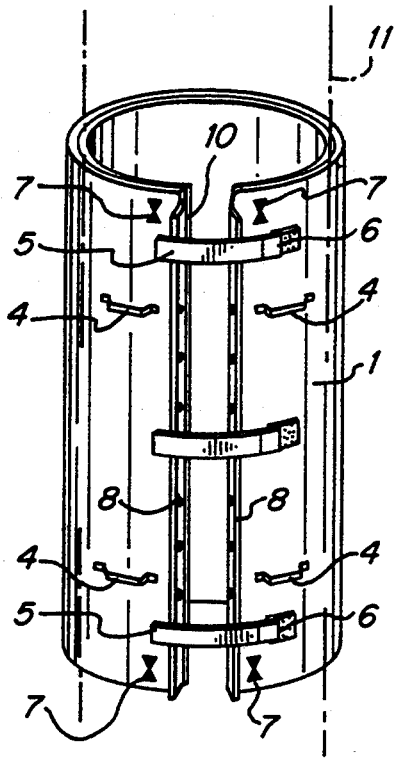
Figure 3:
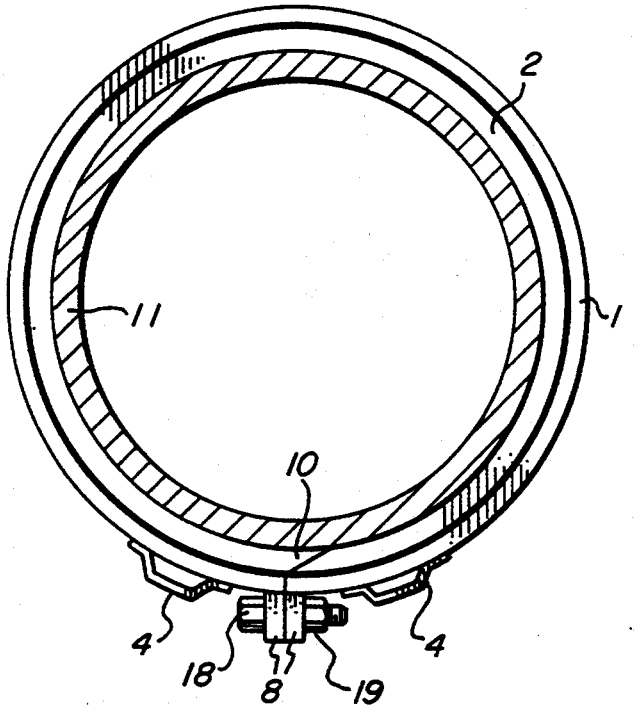
Figure 4:
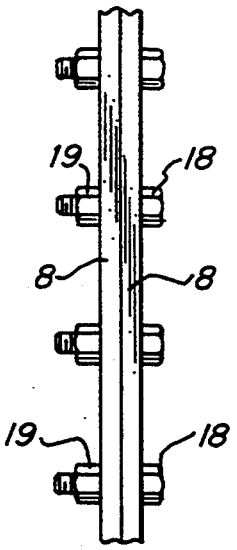
Figure 5:
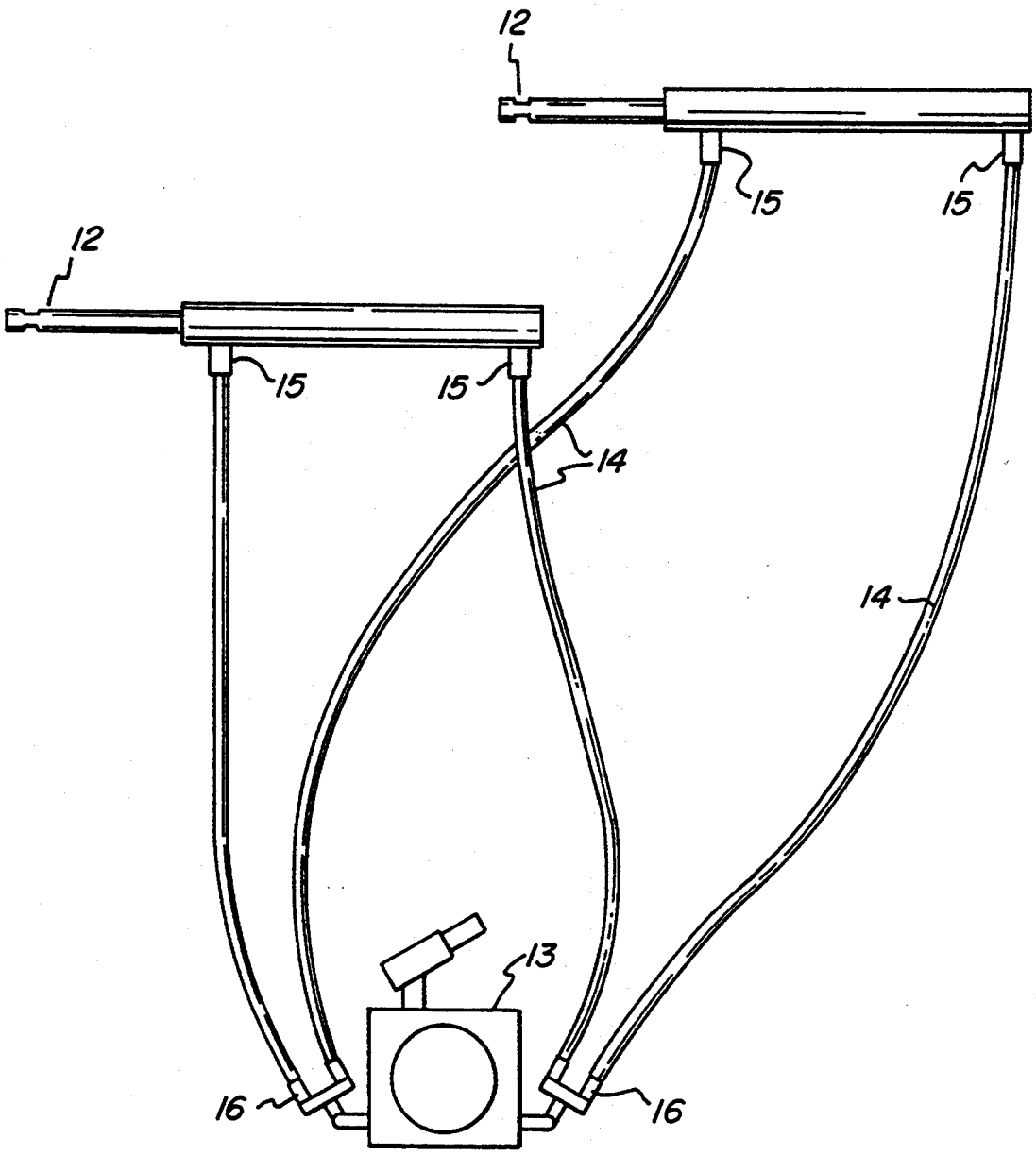

For a better understanding of the invention, one embodiment will now be described, by way of example, with reference to the accompanying drawing, in which:

FIG. 1 is a perspective view of a wrapping sheet in preparation for installing around a pile, FIG. 2 is a perspective view of the sheet in a first stage of installation, FIG. 3 is a cross-section of the pile with the sheet secured around it, FIG. 4 is a diagrammatic elevation of the co-operating edges of the wrapping sheet, and FIG. 5 is a diagram of hydraulic closure apparatus.

The sheet is of composite construction having an outer skin 1 of material such as nylon reinforced Neoprene, 3 mm thick, similar to hovercraft skirt material. Bonded to the rear side-of this is an inner layer 2 of polypropylene felt, 6 mm thick and impregnated with a polymeric thixotropic water-displacing gel sealant, formulated to act as a host for corrosion inhibitors and/or anti-foulants. It will be effective over a wide temperature range, say −40° C. to 150° C. On manufacture this felt is protected by a peel-off backing sheet 3, which remains during transport and handling and is only removed by the divers as they fit the wrapping around the pile. Handles 4 to assist that fitting operation are bonded or otherwise attached to the outer face of the skin 1, as are straps 5 and fasteners 6 for temporary use as described below. The skin 1 also has permanent datum marks 7 for checking the stability of the wrapping.

Sealing members 8 in the form of substantially rigid flanges extend along the edges of the sheet that are to meet when it has been wrapped around a pile. They will project radially outwardly and each has a series of apertures 9 which register when the wrapping is in place. The inner layer 2 is extended beyond one of the flanges 8 to form a flap 10 which will tuck under the opposite inner edge portion of the layer 2 and form an overlap, thus ensuring a good seal. If it is known that the wrapping will be used singly, the flanges 8 may extend the full length of their respective edges, but if several are to be used in series along a pile, the flanges 8 will be short of each end, by 75 mm or thereabouts, for reasons explained below. FIGS. 1 and 2 show a hybrid, with the flanges 8 short at the top end only.

For installation, the sheet is folded concertina fashion as shown in FIG. 1. It may be loosely held thus by ropes or straps. It is then supported by variable buoyancy bags and floated to the pile to be wrapped. Divers release and unfold it, wrapping it around the pile, which will have been locally cleaned as mentioned above. Once roughly in place, it can be loosely secured by the straps 5 and fasteners 6 as shown in FIG. 2, and usually one at the top, one at the bottom and one at the middle will suffice. The wrapping can then be adjusted longitudinally of the pile 11.

Once precisely in position, power means are applied to the members 8 to draw the wrapping tight. In the preferred system, hydraulic rams 12 as shown in FIG. 5 are used, attached to a diver operated handpump 13 via flexible hoses 14. These have swivel connections 15 at their ends to the rams 12 and to the T-pieces 16 or manifolds at the pump 13. Although only two rams are shown, for wrappings of any length it will be preferred to use three, applied to the top, bottom and middle of the members 8 adjacent the straps 5. The ram rods 17 are inserted through the registering bolt apertures 9 and quick-lock nuts are fitted to their ends. The rams are then briefly actuated to apply a light tension to the wrapping.

Further rams operable by a second pump are then applied to other registering bolt apertures 9, preferably alternate ones, leaving half the apertures free. The temporary straps 5 can then be loosened or removed. One of the divers operates the first hand hydraulic pump to contract the rams at top and bottom and middle, and the second pump is operated to obtain even closure of the seal. Once the wrapping has been checked that it is free from wrinkles and correctly aligned, non-metallic bolts 18 are inserted into the vacant apertures, and nuts 19 are fitted and done up finger tight. The hydraulic pumps are then operated again to achieve full face to face closure of the sealing members 8. The nuts are tightened and the rams are removed.

This exposes the other half set of alternate apertures, into which bolts 18 are then fitted and secured by nuts 19. Tightening of these is completed, preferably using an air-operated "nut spinner", and then nylon locking rings are installed on each bolt. During these tightening operations, the impregnated sealant Will be exuded into any surface irregularities and between the members 8 to complete the encasement and protection of the wrapped zone.

Finally, the datum marks 7 are used to measure and note the extension achieved, and this will be compared against a table, and recorded for future reference and checks.

Where a greater length of pile is to be wrapped, two or more such sheets are applied and butt jointed together, using ones where the members 8 do not extend right to the ends. There might be an overlap of the inner layers in the manner of the flap 10. Over this joint there will be placed a band or "cummerbund", which is simply a foreshortened version of the wrapping described with similar flanges by which it is stretched tight and secured in the manner of the main wrappings. It may not need such a substantial inner layer and its flanges will preferably be offset circumferentially from those of the main wrappings to ensure a good seal. Generally, the flanges 8 of the main wrappings will be arranged to be downstream in relation to the most powerful tidal stream or current expected and the offset of any cummerbund will preferably be 10°–30°.

Such wrapping can be removed by reversing this procedure. Unless its removal is occasioned by damage it will normally be possible to replace it.

Minor punctures of the outer skin 1 will self seal as radial hoop stresses in the material will cause the permanently soft sealant impregnated in the inner layer to exude and fill a punctured cavity. However, even major cuts and tears will remain stable, the tension placed on the material during installation being less than that which causes tears to propagate. But, even though it will not be totally immune to damage, such a wrapping will provide additional impact resistance being, in effect, a cushion around the pile.

In general, a particular material for the outer skin 1 has not yet been settled and different ones may be suitable for different applications. Polyester reinforced polychloroprene is one further example being considered. Likewise there may be suitable materials for the inner layer 2 other than the polypropylene referred to above, and rather than felt the material may be homogeneous but porous.

It is envisaged that future applications for or modifications of the system will include the loading of polychloroprene rubber (forming the outer or only skin) with conductive particles of the type used in the construction of sacrificial anodes. An alternative approach is to make the wrapping, as a single or multi-skin jacket, of materials that will give it a very high dielectric constant; this alone should be an efficacious cathodic protection device. Both forms will provide a flexible anode assembly or a shield by which cathodic protection effects could be directed into suspected vulnerable areas of subsea structures.

A further application is to use the system as a carrier for anti-foulant materials, preventing marine growth build up and consequent increase in current drag forces on subsea platform legs, risers and caissons. This could be achieved by providing an additional outer skin, conveniently a foamed polymer matrix for the anti-foulant material, such as copper particles. If used solely for this purpose the inner sealant layer could be dispensed with. It will be understood however, that a single wrapping could combine any of these functions.

I claim:

1. A pile or riser wrapping comprising a water-impermeable, reinforced, flexible and elastic plastic sheet with substantially rigid outwardly extending flanges along substantially the entire length of the opposed edges which are adjacent when the wrapping is positioned around a pile, the flanges affording counter-abutments for the application of a tool by which hoop stresses to make said wrapping resistant to wave suction forces can be imposed on the wrapping and having detents at intervals along their length to accept fastening elements securable while the hoop stresses are maintained, and wherein the sheet comprises an outer skin of water-impermeable and flexible material, and an inner layer of liquid-permeable plastic material bonded to the skin and impregnated with a water resistant sealant.

2. A method of protecting a pile or riser comprising the following steps: wrapping around said pile or riser a pile or riser wrapping as defined by claim 1; and applying hoop stresses to said pile or riser wrapping, said hoop stresses being sufficient to prevent said pile or riser wrapping from being sucked off said pile or riser by wave action.

3. A wrapping as claimed in claim 1, wherein the inner layer has an extension beyond one said opposed edge to tuck under the other opposed edge portion when the wrapping is positioned around a pile.

4. A wrapping as claimed in claim 1, wherein the impregnated sealant has corrosion inhibiting and/or anti-foulant properties, and is a thixotropic gel.

5. A wrapping as claimed in claim 4, wherein the impregnated sealant does not form a permanent bond to a pile surface, and wherein the fastening means are releasable.

6. A wrapping as claimed in claim 5, wherein the inner layer and sealant are covered by a removable backing sheet discarded before positioning around a pile.

7. A wrapping as claimed in claim 6, wherein the sheet is adapted to form an element of a cathodic protection system, being a carrier for sacrificial anode material and providing a jacket with a high dielectric constant.

8. A wrapping as claimed in claim 1, wherein the sheet is outwardly provided with handles for assisting maneuvering the wrapping into position, and with temporary strap fastening means for holding the wrapping loosely in position around a pile while at least some of the fastening elements are secured.

9. A wrapping as claimed in claim 8, wherein the sheet is outwardly provided with gauge marks to provide an indication of the hoop stresses imposed.

10. A wrapping as claimed in claim 9, wherein the detents in said flanges are apertures and wherein the fastening elements are bolts.

11. A method of protecting a pile comprising wrapping a sheet according to claim 10 around the pile, drawing said opposed edges together by at least one said tool to create hoop tensions that are resistant to wave suction forces, securing said fastening elements while the hoop stresses are maintained, and a water-tight seal between the pile and wrapping is formed; then removing said tool or tools.

12. A method as claimed in claim 11, wherein said tools are engaged through some of said apertures to draw the opposite edges together, whereafter bolts are engaged through others of said apertures in a first securing operation, and wherein the tools are removed and replaced by bolts in a second securing operation.

13. A wrapping as claimed in claim 1, wherein the outer skin is nylon reinforced neoprene or polyester reinforced polychloroprene.

14. The wrapping of claim 1, wherein the outer skin has a thickness on the order of 3 mm, and the inner layer has a thickness on the order of 6 mm.

15. The wrapping of claim 1, wherein the sealant is permanently soft.

16. A pile or riser wrapped with the wrapping of claim 1.

17. A pile or riser wrapping comprising a water impermeable reinforced, flexible and elastic plastic sheet that is provided with fastening means along its opposed edges which allow the application of hoop stresses in said wrapping to make said wrapping resistant to wave suction forces and, wherein said sheet comprises an outer skin of said water impermeable reinforced, flexible and elastic material and an inner layer of a liquid permeable felted or porous plastic material bonded to the skin and impregnated with a water resistant sealant.

18. A pile or riser wrapping as claimed in claim 17, wherein the flexible and elastic plastic sheet is nylon reinforced neoprene or polyester reinforced polychloroprene.

19. A wrapping as claimed in claim 17, wherein the outer skin is nylon reinforced neoprene or polyester reinforced polychloroprene, the inner liquid permeable felted or porous plastic material is a polypropylene felt impregnated with sufficient polymeric thixotropic water-displacing gel sealant to form a water-tight seal with the pile or riser when the wrapping is subjected to hoop stress.

20. The wrapping of claim 19, wherein the outer skin has a thickness on the order of 3 mm and the inner layer has a thickness on the order of 6 mm.

21. A pile or riser wrapped with the wrapping of claim 17.

22. A wrapping as claimed in claim 17, wherein the inner layer of the liquid permeable felted or porous plastic material is impregnated with sufficient polymeric thixotropic water-displacing gel sealant to form a water-tight seal with the pile or riser when the wrapping is subjected to hoop stress.

23. A wrapping as claimed in claim 22, wherein the outer skin is nylon reinforced neoprene or polyester reinforced polychloroprene, and the inner liquid permeable felted of porous plastic material is polypropylene.

24. A pile or riser wrapped with the wrapping of claim 22.

25. A method of protecting a pile or riser comprising the following steps: wrapping around said pile or riser a pile or riser wrapping as defined in claim 17; and applying hoop stresses to said pile or riser wrapping, said hoop stresses being sufficient to prevent the pile or riser wrapping from being sucked off said pile or riser by wave action.

* * * * *